US005275409A

United States Patent [19]

Currie

[11] Patent Number: 5,275,409

[45] Date of Patent: Jan. 4, 1994

[54] PUTTER

[76] Inventor: Kirk Currie, 27326 Robinson Rd., #209, Oak Ridge, Tex. 77385

[21] Appl. No.: 912,304

[22] Filed: Jul. 13, 1992

[51] Int. Cl.[5] ..... A63B 53/02

[52] U.S. Cl. ..... 273/80.7; 273/167 J; 273/80.2

[58] Field of Search ..... 273/80R, 80C, 80.1, 80.2, 80.7, 167R, 167G, 167J

[56] References Cited

U.S. PATENT DOCUMENTS

| | | | |
|---|---|---|---|
| 1,334,189 | 3/1920 | Swanson | 773/80.1 X |
| 2,064,943 | 12/1936 | Reach | 273/80.7 |
| 2,076,340 | 4/1937 | Hadden | 273/80.7 |
| 2,231,847 | 2/1941 | Dickson et al. | 273/80.7 |
| 5,137,275 | 8/1992 | Nelson | 273/80.2 X |

FOREIGN PATENT DOCUMENTS

| | | | |
|---|---|---|---|
| 646942 | 8/1962 | Canada | 273/80.7 |

*Primary Examiner*—V. Millin
*Assistant Examiner*—Raleigh W. Chin
*Attorney, Agent, or Firm*—Harrison & Egbert

[57] ABSTRACT

A putter having a putter head with a vertical flat machined surface thereon and a hosel threadedly connected to the putter head. The putter head has a hole extending into a top surface toward a bottom surface. The hosel has a portion extending into the hole. The hosel has a shaft receiving opening on an end opposite to the portion extending into the hole for receiving a shaft therein. The putter head and the hosel are made of a leaded steel or brass material. The hole is threaded within the putter head for receiving the threads of the hosel in mating engagement. The hole extends in parallel relationship to the machined surface generally adjacent to the machined surface.

17 Claims, 2 Drawing Sheets

PUTTER

TECHNICAL FIELD

The present invention relates to golf clubs in general. More particularly, the present invention relates to putters and methods for attaching shafts to putter heads.

BACKGROUND ART

In the game of golf, the most exacting and difficult part of the game for most golfers is putting. This is indicated by the fact that many golfers change their putters several times during the course of a golf season in order to attempt to discover a putter with a "right feel." In the construction of putters, as well as other types of golf clubs, it is well recognized that the degree of resilience of the club head plays an important roll in the accuracy and distance imparted to a golf ball by the club head. Club head resilience also has a great effect on the "feel" of a putter in striking the golf ball.

There has been two recent developments in the technology of putters that have greatly increased the feel and accuracy of the putter design. The first is the development of the machined surface on the putter head. Typically, putter heads have been made of cast material. Unfortunately, even with the most precise casting techniques, a truly flat surface cannot be formed. The casting process will conventionally cast the putter head and the hosel as a single unit. Any variation on the true flatness of the putter will detract from putting accuracy. The putter will not be considered as "true" to the golfer. Virtually all putters, at present, are made from castings.

The process of machining provides a technique in which a very flat surface can be placed upon the putter head. Normal casting processes will leave bubble holes and other inconsistencies in the material quality. In order to properly machine a putter head, the putter head must begin with a stock of forged material. The putter head can then be put through a milling machine so as to place a flat surface on the putter head. Unfortunately, machined putter heads are not common and have not been widely adopted. Part of the problem with machined putter heads is the fact that it is expensive and extremely difficult to machine a hosel in direct connection to the putter head. In the present, it is necessary to weld a hosel to the exterior surface of the machined putter head. It has been found that the welding of a hosel to the exterior of the machined putter head does not provide an adequate "feel" to the person using the putter. In addition, the process of welding tends to heat treat the putter head and, thusly, tends to distort the true consistency and hardness of the material itself.

The other important development has been the use of soft leaded steel and brass materials for the putter head. It is generally true that the softer the material of the putter head, the better the "feel" of the putt. It has been found that leaded steel materials and brass are excellent materials which properly convey the "feel" of the striking of the ball. In the past, brass putter heads and hosels have been made through the casting process. It has not been possible, in the past, to create a suitable machined brass putter head since brass is not a material that is easy to weld. It has also been difficult to make a putter head of a leaded steel material since such leaded steel materials cannot be cast and ca only be welded with great difficulty.

In the past, various U.S. patents have been directed to the threaded attachment of a shaft to a club head. U.S. Pat. No. 1,334,189, issued on Mar. 16, 1920, to A. S. Swanson shows a driving head having a pair of intersecting angled threads extending into the head. The shaft is directly connected by threading into one of the angled holes. The dual holes are provided so as to make the driving club adaptable to either left-hand or right-hand use. Rubber strips are fastened to the exterior surfaces of the head for added resiliency.

U.S. Pat. No. 1,840,924, issued on Jan. 12, 1932, to E. E. Tucker shows a golf club having a cast head. A shank is formed into the cast head which includes a thread extending thereinto. The shaft of the club is threadedly connected into the threaded shank.

U.S Pat. No. 2,129,068, issued on Sep. 6, 1938, to W. F. Reach shows a similar type of golf club having a cast club head. The cast club head includes an upwardly extending shank portion. A hole is drilled into the shank portion so as to receive a threaded hosel. The threaded hosel is connected to the shaft of the club.

U.S. Pat. No. 2,231,847, issued on Feb. 11, 1941, to J. B. Dickson et al. also provides a golf club with a cast-type club head having a shank portion extending upwardly from an end of the club head. The shank portion includes a threaded opening for receiving a threaded metal shaft. The threaded metal shaft is internally received within the golf club shaft. The threaded metal shaft extends into the threaded shank of the golf club head.

U.S. Pat. No. 3,170,691, issued on Feb. 23, 1965, to F. C. Pritchard provides a golf club shaft and hosel connector. The club head is a cast-type head having a threaded shank extending upwardly from the end of the club head. The shaft of the club is connected to the golf club head by a threaded hosel having a pin connector for preventing relative rotation between the shaft and the club head.

U.S. Pat. No. 3,397,888, issued on Aug. 20, 1968, to D. R. Springer et al. shows an adjustable golf putter in which a plurality of holes are formed into the top surface of the putter head. A pivotable connector is provided for threaded receipt within the holes. The shaft of the club is connected within a plastic sleeve. The shaft can be manipulated angularly with respect to the putter head.

U.S. Pat. No. 3,429,576, issued on Feb. 25, 1969, to Y. Ikeda provides a golf club having a level indicating means and a weight means. A level indicator is provided on the top surface of the club head. The shaft of the club is received within a threaded opening formed within the shank portion of the club head.

British Patent Application No. 2 225 959 A, published on Jun. 20, 1990, to N. W. Wharton, provides a golf club having a golf club assembly with a bore and a screw-threaded portion. A shaft assembly has a ferrule and a screw-threaded portion. The club head assembly is screw-threadedly engaged on the end of the shaft assembly. A plug is inserted to prevent disassembly.

Additionally, Canadian Patent No. 646,942, issued on Aug. 21, 1962, to E. S. Giza illustrates a hollow-headed golf putter. The shaft of the putter is angularly connected within threaded openings on the putter head. The hollow-headed golf putter is intended for resiliency so as to affect the putting action.

It is an object of the present invention to provide a putter which provides greater feel to the golfer.

It is another object of the present invention to provide a putter having a machined flat surface.

It is another object of the present invention to provide a putter made of leaded steel or brass material.

It is still a further object of the present invention to provide a completely machined putter that is easy to assemble, relatively inexpensive, and easy to manufacture.

These and other objects and advantages of the present invention will become apparent from a reading of the attached specification and appended claims.

SUMMARY OF THE INVENTION

The present invention is a putter which comprises a putter having a vertical flat machined surface thereon and a hosel threadedly connected to the putter head. The putter head has a hole extending thereinto for the receipt of a portion of the hosel. The hosel has a shaft receiving opening at an end opposite to the portion which extends into the hole. The shaft receiving opening receives the shaft of the golf club.

Both the putter head and the hosel are comprised of a leaded steel or brass material. The putter head has a bottom surface and a top surface. The machined surface extends between the top surface and the bottom surface. The hole extends into the top surface toward the bottom surface. The hole terminates adjacent to the bottom surface.

The hole is threaded within the putter head. The hosel has threads thereon which are in mating engagement with the threaded hole. The threads are left-handed threads. The hosel has no less than twenty threads per inch in connection with the threaded hole of the putter head. The hole extends parallel to the machined surface. The hole has a longitudinal axis within one quarter inch of the machined surface.

The present invention is also a method of manufacturing a putter which comprises the steps of: (1) forming a putter head having a flat surface thereon; (2) drilling a hole into the putter head in generally parallel relationship with the flat surface; (3) forming a hosel having a shaft-receiving opening at one end; and (4) attaching the portion of the hosel within the hole of the putter head.

The step of forming the putter head specifically comprises forging a stock of leaded steel or brass material and machining the flat surface onto the stock. The step of drilling includes forming an internal thread within the hole such that the internal thread has a size for mating engagement with a portion of the hosel. This internally threaded hole is positioned within one quarter inch of the flat surface. The step of forming the hosel comprises machining a thread on a portion of the hosel. The step of attaching comprises threading the threads of the hosel into the internal thread of the putter head so that the hosel is in tight engagement with the putter head. The shaft receiving opening of the hosel extends outwardly of the putter head.

DETAILED DESCRIPTION OF THE INVENTION

Figure 1:
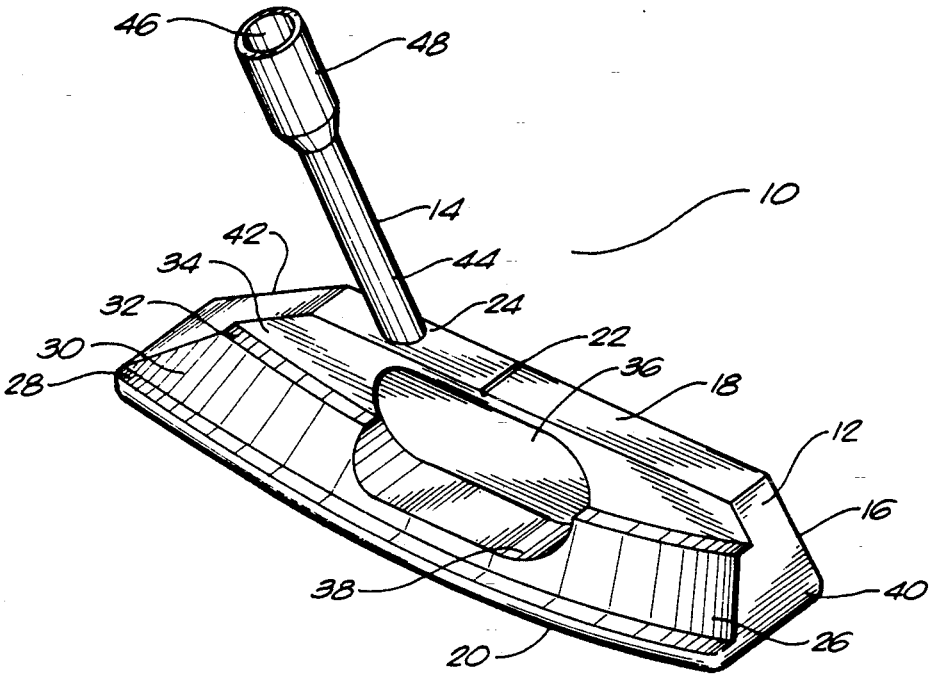
FIG. 1 is a perspective view of the putter of the present invention.

Referring to FIG. 1, there is shown at 10 the putter in accordance with the preferred embodiment of the present invention. Putter 10 comprises a putter head 12 and a hosel 14. The hosel 14 is threadedly connected within the interior of putter head 12.

Putter head 12 is a machined putter head made of leaded steel material. Typically, the stock from which the putter head is formed is from a leaded cold finish steel bars identified as grade 11L17 or as grade 12L14. Putter head 12 includes the flat machined surface 16. Surface 16 is the surface which contacts a golf ball during putting action. The machined surface 16 extends between top surface 18 and bottom surface 20. In the embodiment shown in FIG. 1, the bottom surface 20 is slightly curved. However, the curvature of bottom surface 20 is not intended as a limitation of the present invention. The curvature of bottom surface 20 is simply a stylistic aspect of the present invention.

The top surface 18 includes a sight line 22 extending thereacross. In common usage, the sight line 22 is intended to assist the golfer in lining the golf ball with the hole. The sight line 22 is machined into the top surface 18 of putter head 12. It can be seen that the top surface 18 is generally flat. An opening 24 extends into the putter head 12 from the top surface 18 for the purpose of receiving the hosel 14, as will be described hereinafter.

The back side 26 of putter head 12 includes various machined surfaces. The configuration of the back side 26 includes a shoulder 28 in parallel relationship to and adjacent to the bottom surface 20. An angled wall 30 extends upwardly from shoulder 28 and terminates at shoulder 32. A vertical surface 34 extends downwardly from top surface 18 in parallel relationship to the machined surface 16. Vertical surface 34 extends upwardly from the shoulder 32. The configuration of the back side 26 of putter head 12 is also a stylistic aspect of the present invention. It is not intended as a limitation, in any way, of the present invention.

The back surface of putter head 12 also includes flat area 36 which is in general alignment with the flat surface 34. A curved opening 38 extends into the angled surface 30 and the shoulder 32. The area 36 is intended for the receipt of indicia, such as trademarks.

The putter head 12 includes one angled end 40 and an opposite angled end 42. Angled end 40 extends from top surface 18 to the bottom surface 20. Similarly, the opposite angled end 42 extends from top surface 18 to the bottom surface 20. These angled ends enhance the appearance and aesthetics of the putter head 12.

Hosel 14 extends outwardly from top surface 18 through opening 24. Hosel 14 has a solid body portion 44 of a tubular shape. The body portion 44 is intended for solid connection between the shaft of the putter and the putter head 12. The shaft of the putter is received within opening 46 on end portion 48 of hosel 14. The diameter of opening 46 should be suitable for the receipt of a conventional shaft. When the shaft is installed into the opening 46 of end portion 48 of hosel 14, the putter 10 of the present invention is ready for use.

Although the preferred embodiment of the present invention utilizes a leaded steel material, the putter head may also be made of brass. Brass is a soft metal which is generally unweldable. Brass has many of the same qualities as the leaded steel except for the fact that brass can be poured and cast.

Figure 2:
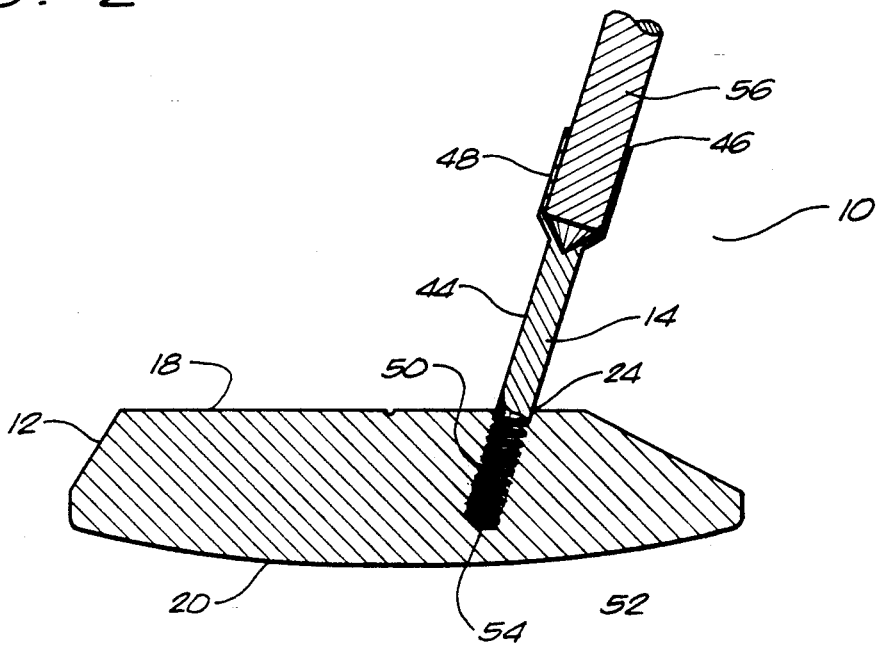
FIG. 2 is a cross-sectional view, in side elevation, of the putter of the present invention.

The inventive aspects of the present invention are shown, with particularity, in FIG. 2. Importantly, in FIG. 2, it can be seen that the hosel 14 has a threaded portion 50 which is received on the interior 52 of putter head 12. It can be seen that the threaded portion 50 of hosel 14 extends through the opening 24 on the top surface 18 of putter 12. The threaded portion 50 extends into the interior 52 of putter head 12 at an angle. The end 54 of threaded portion 50 terminates adjacent to the bottom surface 20 of the putter head 12. It can also be seen that the threaded portion 50 of hosel 14 is generally in proximity to the center area of the putter head 12. It has been found that the proximity of the threaded portion 50 to the point of impact between the putter head 12 and the ball greatly enhances the "feel" of the putting action to the golfer.

In FIG. 2, it can further be seen that the opening 46 on the end portion 48 of hosel 14 receives a shaft 56 therein. The shaft 56 can be attached within the opening 46 in various ways. It can further be seen that the body portion 44 of hosel 14 is solid between the threaded portion 50 and the end portion 48.

The threaded portion 50 engages left-handed threads in the putter head 12. This configuration has specifically been designed for right-handed putters. The use of left-handed thread threads prevents the inadvertent rotation of the putter head 12 with respect to the hosel 14. All of the vibration and jarring that occurs to the putter head through the action of putting will be transmitted so a to tighten the putter head onto the threaded portion 50 of hosel 14. It is not necessary to further enhance the securing forces between the hosel 14 and the putter head 12 by welding adhesives, or other techniques.

Figure 3:
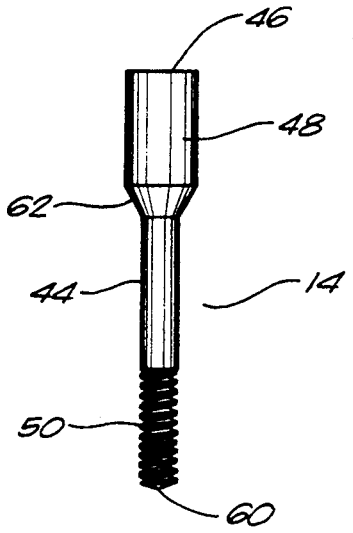
FIG. 3 is a side elevational view of the hosel of the present invention.

FIG. 3 is an isolated view of the hosel 14. In FIG. 3, it can be seen that the threaded portion 50 extends downwardly to end 60 of hosel 14. Body portion 14 extends from the threaded portion 50 to the end portion 48. A frustoconical section 62 is provided between the body portion 44 and the end portion 46. The open end 46 allows for the introduction of a shaft into the cylindrical interior of the end portion 48.

The threaded portion 50 of hosel 14 is configured so as to matingly engage the internal threads of the putter head 12. In the preferred embodiment of the present invention, the threads 50 are left-handed threads. However, for left-handed golfers, the present invention may be configured so as to have right-handed threads. The threaded portion 50 is made up of one-quarter inch threads. The threaded portion 50 is machined onto the hosel 14. In the preferred embodiment of the present invention, the threads 50 should occur at not less than twenty threads per inch. In experiments with the present invention, it has been found that the greater frequency of threads and the greater amount of contact area between the external threads 50 of hosel 14 and the internal threads of the putter head 12 greatly enhance the "feel" of the putter 10. It is believed that a greater number of threads than that which is shown would additionally enhance the "feel" of the putter.

Figure 4:
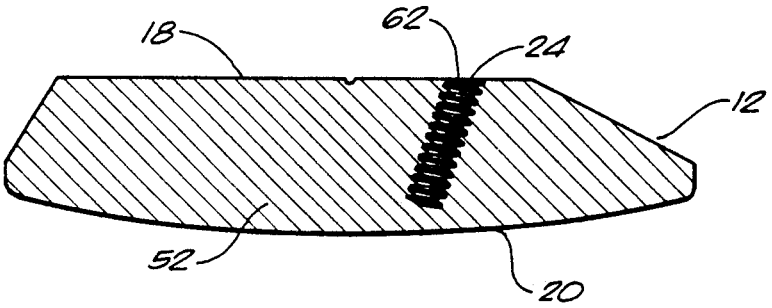
FIG. 4 is a cross-sectional view in side elevation, of the putter head of the present invention.

FIG. 4 shows the cross-section of putter head 12. In particular, it can be seen that internal threads 62 are formed within the interior 52 of putter head 12. These internal threads 62 are formed by drilling and tapping. The internal threads 62 should extend downwardly from the top surface 18 toward the bottom surface 20 of putter head 12. It is desirable that the internal thread 62 extend, as close as practicable, to the bottom surface 20. It has been found, with experimentation, that the length of the threaded portion 62 (and the received threaded portion of the hosel) is proportional to the feel provided to the golfer. In keeping with the present invention, it is even possible that the internal thread 62 of putter head 12 could extend all the way to the bottom surface 20. As can be seen, the threaded portion 50 of hosel 14 can enter the internal thread 62 of putter head 12 by way of opening 24. The rotation of the hosel 14 will naturally cause the external threads of hosel 14 to engage the internal threads 62 of putter head 12. The rotation should continue until the hosel 14 is tightly received within the putter head 12.

Figure 5:
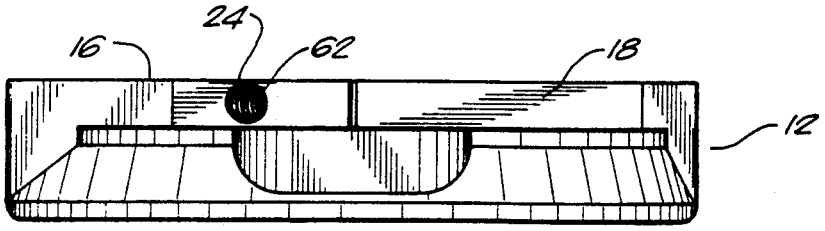
FIG. 5 is a top view of the putter head of FIG. 4.

FIG. 5 shows a top view of the putter head 12 as shown in FIG. 4. Importantly, it can be seen that the opening 24 occurs on the top surface 18 of putter head 12. The internal threads 62 extend downwardly from this top surface 18 toward the interior of the putter head 12. It can be seen that the internal threads 62 have a longitudinal axis which is adjacent to the flat machined surface 16 of putter head 12. After experimentation, it is believed that the preferred embodiment of the present invention will have the longitudinal axis of the internally threaded hole 62 within one-quarter of an inch from the machined surface 16. It has been found, with experimentation, that the proximity of the hole 62 to the surface 16 has a great effect on the feel generated by the putter head 12. Hole 62 will have a diameter of approximately one-quarter of an inch.

It should be noted that the present invention has alternative embodiments which are available within the scope of the present invention. In particular, the requirements of the present invention demand that a hole be formed through the interior of putter head 12. However, it is possible to provide an additional hole on the bottom surface 20 of the putter head 12 so that a threaded bolt-type member can be joined to an internal thread within the hosel 14. As such, as the term "threadedly connected" is used in the present invention, such language is intended to encompass such a scheme of connection and other arrangements of threaded connections.

The present invention further contemplates a method of manufacturing the putter which includes forming the putter head 12 so as to have a flat surface 16 machined thereon. The hole 62 is then drilled into the top surface 18 of the putter head 12 in generally parallel relationship with the machined surface 16. The hosel is also machined so as to have a shaft-receiving opening 46 at one end. The hosel 14 has a portion 50 which is suitable for receipt within the hole 62 of putter head 12. The method of the present invention includes the step of threadedly attaching this portion 50 of the hosel 14 within the hole 62 of the putter head 12.

The step of forming the putter head includes forging a stock of leaded steel or brass material and machining the flat surface 16 onto the stock of material. Typically, a milling operation is performed so as to provide an extremely flat surface. The step of drilling includes forming the internal threaded hole 62 suitable for engagement with the threaded end of the hosel. The 62 is drilled within one-quarter inch of the flat surface 16 of putter head 12. The hosel is machined so as to form a thread thereon. The hosel is machined from a stock of similar material as the putter head. The hosel 14 is then attached to the putter head 12 by simply rotating the hosel 14 such that the threads 50 of hosel 14 engage the internal threads 62 on the putter head 12.

The present invention offers advantages over prior putters. Initially, it can be seen that the present invention has envisioned a manner in which a hosel can be fastened to a leaded steel or brass machined putter head. The threads extend into the interior of the putter head 12 so that a length of threads on the hosel 14 can be affixed therein. It has been found that the use of threads give a greater feel of the putting action to the golfer. The use of leaded steel or brass is a softer material. In normal use, it has been found that a soft metal is a preferred type of material for putter heads. The putter 10 of the present invention also provides greater feel by placing the threaded hosel adjacent to the point of impact between the golf ball and the machined surface and also by placing the threaded hosel adjacent to the machined surface itself.

The threaded connection of the hosel 14 to the putter head 12 avoids the heat treatment of leaded steel or brass material which is required for the welding of a hosel to a putter head. Since welding cannot easily be carried out with leaded steel or brass material, the present invention accommodates that difficulty by providing a threaded attachment.

The present invention utilizes a machined material. This avoids the problems associated with the use of cast putter heads. The machined surface 16 of the putter head is flat and true. There are no bubble holes or material inconsistencies on that surface of the putter head which encounters the golf ball.

Additionally, and furthermore, the present invention is easily assembled. It is adaptable for a wide variety of materials. The present invention provides the aforestated benefits at a relatively low cost.

The foregoing disclosure and description of the invention is illustrative and explanatory thereof. Various changes in the details of the illustrated construction, or the steps of the described method, may be made within the scope of the appended claims without departing from the true spirit of the invention. The present invention should only be limited by the following claims and their legal equivalents.

I claim:

1. A putter comprising:

a putter head having a vertical flat machined surface thereon, said putter head having a hole extending thereinto; and a hosel threadedly connected to said putter head, said hosel having a portion extending into said hole, said hosel having a shaft receiving means at an end opposite said portion extending into said hole, said shaft receiving means for receiving a shaft therein said hole being threaded within said putter head, said portion of said hosel having threads thereon in mating engagement with said hole.

2. The putter of claim 1, said putter head and said hosel comprised of a soft metal selected from the group consisting of: leaded steel and brass.

3. The putter of claim 1, said putter head having a bottom surface and a top surface, said machined surface extending between said top surface and said bottom surface, said hole extending into said top surface in parallel relationship to said machined surface.

4. The putter of claim 3, said hole extending adjacent said bottom surface.

5. The putter of claim 1, said threads being left-handed threads.

6. The putter of claim 1, said portion of said hosel having not less than twenty threads per inch.

7. The putter of claim 1, said hole extending parallel to said machined surface, said hole having a longitudinal axis positioned within one quarter inch of said machined surface.

8. A putter comprising:

a putter head of a soft metal, said putter head having a flat surface thereon, said putter head having a hole extending therein adjacent said flat surface, said soft metal selected from the group consisting of: leaded steel and brass; and a hosel threadedly connected to said putter head, said hosel having a portion received by said hole, said hosel having a shaft receiving means thereon exterior of said putter head, said shaft receiving means for receiving a shaft therein said hole being threaded within said putter head, said portion of said hosel have threads in mating engagement with said hole.

9. The putter of claim 8, said hole having a longitudinal axis positioned within one quarter inch of said flat surface.

10. The putter of claim 9, said putter head having a bottom surface and a top surface, said flat surface being a machined surface extending between said top surface and said bottom surface, said hole extending into said top surface and toward said bottom surface.

11. The putter of claim 8, said hosel comprised of a similar material as said putter head.

12. The putter of claim 8, said threads being left-handed threads, said threads being not less than twenty threads per inch.

13. The putter of claim 8, said putter head being of a forged material, said flat surface being a machined surface.

14. A method of manufacturing a putter comprising:

forming a putter head having a flat surface thereon;

drilling a hole into said putter head in generally parallel relation with said flat surface;

forming a hosel having a shaft receiving opening at one end, said hosel having a portion with a diameter less than a diameter of said hole, said step of drilling comprising:

forming an internal thread within said hole such that said internal thread has a size for mating engagement with said portion of said hosel, said hole positioned within one quarter inch of said flat surface; and attaching said portion of said hosel within said hole of said putter head.

15. The method of claim 14, said step of forming a putter head comprising:

forging a stock of leaded steel material; and milling said flat surface on said stock.

16. The method of claim 14, said step of forming a hosel comprising:

machining a thread on said portion of said hosel, said thread having not less than twenty threads per inch, said hosel being of a leaded steel, said threads being left-handed threads.

17. The method of claim 16, said step of attaching comprising:

threading said thread of said portion of said hosel into said internal thread of said putter head, said hosel having said opening extending outwardly of said putter head for receiving a shaft therein.

* * * * *